United States Patent [19]

Takahashi et al.

[11] 4,087,341

[45] May 2, 1978

[54] PROCESS FOR ELECTROGRAINING ALUMINUM SUBSTRATES FOR LITHOGRAPHIC PRINTING

[75] Inventors: Masahiro Takahashi, Shizuoka; Teruo Miyashita; Akira Morita, both of Fuji; Ken Sato, Shimizu, all of Japan

[73] Assignee: Nippon Light Metal Research Laboratory Ltd., Tokyo, Japan

[21] Appl. No.: 738,945

[22] Filed: Nov. 4, 1976

[30] Foreign Application Priority Data

| | | |
|---|---|---|
| Nov. 6, 1975 | Japan | 50-132496 |
| Jun. 11, 1976 | Japan | 51-67780 |

[51] Int. Cl.[2] ..... C25F 3/04

[52] U.S. Cl. ..... 204/129.43; 204/129.75

[58] Field of Search ..... 204/129.1, 129.43, 129.75, 204/DIG. 8, 58; 101/453, 463

[56] References Cited

U.S. PATENT DOCUMENTS

| | | | |
|---|---|---|---|
| 2,901,412 | 8/1959 | Mostovych et al. | 204/211 |
| 3,072,546 | 1/1963 | Wruck | 204/58 X |
| 3,330,743 | 7/1967 | Jestl et al. | 204/33 |
| 3,861,917 | 1/1975 | Magnotta et al. | 96/33 |
| 3,887,447 | 6/1975 | Sheasby et al. | 204/129.4 |
| 3,892,636 | 7/1975 | Keneda et al. | 204/35 N |

*Primary Examiner*—F.C. Edmundson

*Attorney, Agent, or Firm*—William J. Daniel

[57] ABSTRACT

Aluminum substrates are electrograined for lithographic printing in an electrolytic cell using an electrolyte of hydrochloric acid or nitric acid, and a "regulated alternating current" whereby the inter-electrode voltage is applied with a higher anodic voltage than the cathodic voltage, the ratio of cathodic coulombic input to anodic coulombic input is less than one and preferably in the range of 0.3–0.8, and the anodic half cycle period or time is not longer than the cathodic half cycle period or time, thereby to impart to the substrate a "pits-within-a-pit" grain structure uniformly over its entire surface.

5 Claims, 6 Drawing Figures

FIG. IA
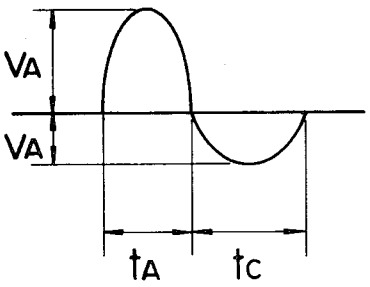
FIG. IB
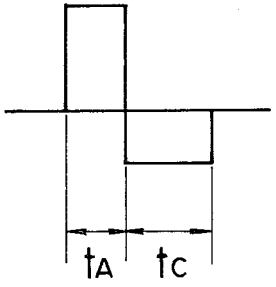
FIG. IC
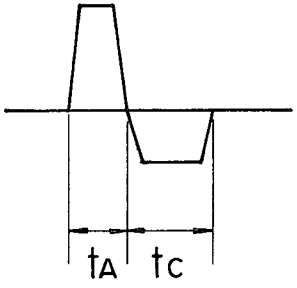

PROCESS FOR ELECTROGRAINING ALUMINUM SUBSTRATES FOR LITHOGRAPHIC PRINTING

BACKGROUND OF THE INVENTION

1. Field of the Invention

The present invention relates to a process for electrograining an aluminum substrate for lithographic printing.

2. Description of the Prior Art

In general, when an aluminum substrate is used as a lithographic plate, the surface is grained beforehand to improve the adhesion of the subsequently applied light-sensitive coating and to improve water retention in the non-image areas during printing. Such graining conspicuously affects the printability and durability of the plate for offset printing, and the quality of the graining is one of important factor in producing effective plates.

Aluminum substrates are conventionally grained for lithographic printing by mechanical graining, such as ball-graining and slurry brushing, or by electrograining. Electrograining, i.e., electrochemical etching in an acidic solution, has become attractive in recent years, because it is suitable for treating not only aluminum sheets cut to a length but continuous strips.

In the electrograining, alternating current is passed between two aluminum plates or sheets facing each other or between an aluminum plate and a suitable counter electrode, such as a graphite plate, in an electrolytic cell containing an electrolyte, the main or sole solute of which is hydrochloric acid or nitric acid. When the electrolyte is mainly nitric acid, the grained surface obtained has relatively finely pitted structure, and shows the so-called "pits-within-a-pit" structure, i.e., the surface is formed of fine pits, which themselves contain many finer pits. However, the depth of the pits is generally shallow. In contrast, when the electrolyte is mainly hydrochloric acid, the depth of the pits is generally deep, but the surface of an individual pit is relatively smooth, and does not exhibit the complex graining as occurs when an electrolyte of nitric acid is used.

Such differences in the topography of the grained surface delicately affects the printability and durability of the plate, thus limiting their application. The substrate grained in an electrolyte of nitric acid is used mainly to produce a plate for relatively short run commercial printing involving delicate printed matter. On the other hand, the substrate grained in an electrolyte of hydrochloric acid is used mainly to produce a plate for long run printing of newspapers, magazines, etc., in which reproduction of delicate images is not required.

Furthermore, it is a common problem in the conventional electrograining process using conventional alternating current, that the electrolyte composition considerably restricts the electrograining conditions to achieve uniform graining, thus limiting the resultant topography and pit size within narrow ranges.

After extensive study, it has been found that the topography and pit size can be varied without imparing grain uniformity by independent control of both anodic and cathodic reactions, and that this can be accomplished by using "regulated alternating current." The phrase "regulated alternating current" as used in the present invention indicates an electric current in which the anodic voltage and the cathodic voltage as well as duty cycle are respectively independently regulated in contrast to conventional AC. When an aluminum substrate for lithographic printing is electrograined using as electrolyte either of hydrochloric acid or nitric acid, a uniformly and finely grained substrate with "pits-within-a-pit" structure can be efficiently obtained within a short time, by using regulated alternating current, which is characterized by applying an inter-electrode voltage in which the anodic voltage ($V_A$) is arranged to be higher than cathodic voltage ($V_C$), thereby adjusting anodic coulombic input ($Q_A$) to be greater than cathodic coulombic input ($Q_C$). The diameter and depth of the pits can be optionally adjusted by properly selecting the ratio of cathodic coulombic input to anodic coulombic input ($Q_C$)/($Q_A$) given by the voltage adjustment.

The object of the present invention is to provide a process for electrograining an aluminum substrate for lithographic printing in which the aluminum substrate is electrograined in an electrolytic cell using an electrolyte of hydrochloric acid or nitric acid with regulated alternating current to apply interelectrode voltage with anodic voltage ($V_A$) arranged to be higher than cathodic voltage ($V_C$).

BRIEF DESCRIPTION OF THE DRAWINGS

FIG. 1A shows a sinusoidal form of a voltage waveform for the regulated alternating current used in the present invention;

FIG. 1B shows a rectangular version of the waveform of FIG. 1A;

FIG. 1C shows a trapezoidal version of the waveform of FIG. 1A;

DETAILED DESCRIPTION OF PREFERRED EMBODIMENTS

The hydrochloric acid-based electrolyte of the present invention is an aqueous solution containing 0.05 to 5 weight % of hydrochloric acid, to which slight amounts of inhibitors and stabilizers may be added as known in the art, for example, chlorides such as zinc chloride, ammonium chloride and sodium chloride, amines such as monoamine and diamine, organic compounds such as aldehyde and EDTA, and acids such as phosphoric acid, chromic acid and nitric acid.

The nitric acid-based electrolyte of the present invention is an aqueous solution containing 0.5 to 5 weight % of nitric acid, to which slight amounts of inhibitors and stabilizers may be similarly added, for example, nitrates such as zinc nitrate, ammonium nitrate and sodium nitrate, amines such as monoamine and diamine, organic compounds such as aldehyde and EDTA, and acids such as phosphoric acid, chromic acid and sulfosalicylic acid.

FIGS. 1A–C and 2A–C shows examples of voltage wave-forms for the regulated alternating current of this invention in which the shape of the wave-form varies for two different half cycle duration relationships, but the regulated alternating current of the present invention is not limited to these specific voltage wave-forms.

According to the present invention, aluminum sheet is electrograined using a regulated alternating current having a voltage wave-form of the general type illustrated, and applying an inter-electrode voltage with the anodic voltage ($V_A$) arranged to be higher than the cathodic voltage ($V_C$), as shown in FIG. 1, thereby adjusting the anodic coulombic input ($Q_A$) to be greater than the cathodic coulombic input ($Q_C$). The ratio of the cathodic coulombic input ($Q_C$) to the anodic coulombic input ($Q_A$), i.e., $Q_C/Q_A$ needed to impart to the substrate a grained surface having a uniform and stable "pits-within-a-pit" structure is about 0.3 to 0.8, preferably 0.4 to 0.7, where the electrolyte is of hydrochloric acid, or about 0.4 to 0.8 where the electrolyte is nitric acid.

The preferred voltage range for either electrolyte is from 10V to 50V for the anodic voltage ($V_A$), and cathodic voltage ($V_C$), of course, should be lower than anodic voltage ($V_A$).

Figure 2A:
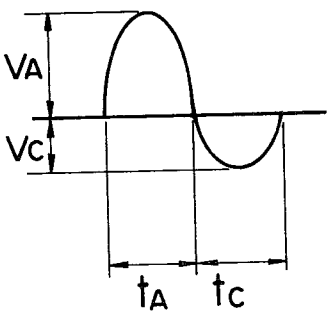
FIG. 2A shows a sinusoidal wave similar to the wave of FIG. 1A, but with the anodic time equal to the cathodic time.
Figure 2B:
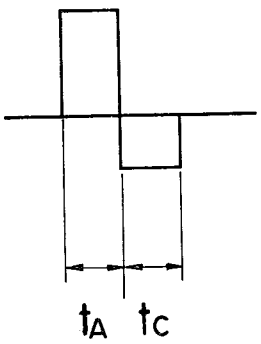
FIG. 2B shows a rectangular version of the wave of FIG. 2A.
Figure 2C:
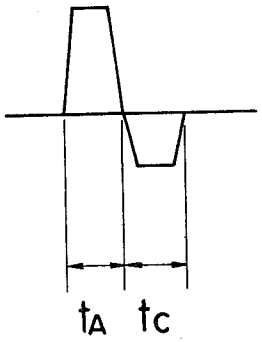
FIG. 2C shows a trapezoidal version of the wave of FIG. 2A.

The anodic half-cycle period or time ($t_A$) in the regulated alternate current can be almost equal to cathodic half-cycle period or time ($t_C$), as shown in FIGS. 2A–C, but by extending the cathodic time ($t_C$) relative to anodic time ($t_A$) in the above-mentioned range of coulombic input ratios ($Q_C/Q_A$) as shown in FIGS. 1A–C makes possible a reduction in the amount of electric energy required for electrograining, and therefore a saving in power consumption and electrolyte consumption.

Furthermore, although the anodic time ($t_A$) in the regulated alternating current can be almost equal to the cathodic time ($t_C$), increasing the cathodic time ($t_C$) to exceed the anodic time ($t_A$) in the above-mentioned range of coulombic input ratio $Q_C/Q_A$ reduces the time needed for electrograining, giving a further saving in power consumption and electrolyte consumption.

The frequency ($f$) in the regulated alternating current of the present invention is not limited to the ordinary AC frequency range, i.e., 50Hz or 60Hz. Higher frequencies tend to form finer pits on the grained surface.

Illustrative examples of the present invention are described below.

EXAMPLES 1 - 20

Aluminum sheets of 99.5% purity (50 × 100 × 0.3mm) were etched in caustic soda solution, rinsed, and electrograined, in electrolytes containing 1 wt % hydrochloric acid concentration at 20° C solution temperature for Comparative Examples 1, 3 and 4, and Embodiments 1 to 19, 1.2 wt % hydrochloric acid concentration at 35° C solution temperature for Comparative Example 2, and 2.7 wt % hydrochloric acid concentration at 35° C solution temperature for Embodiment 20, using various kinds of regulated alternating current with voltage wave-forms as shown in FIGS. 1 and 2, i.e., sinusoidal wave, rectangular wave, trapezoidal wave, etc., having different anodic and cathodic voltages ($V_A$, $V_C$), anodic and cathodic times ($t_A$, $t_C$), frequency ($f$), etc. Then, the smut adhering to the sheet surfaces was removed by immersion in a hot solution of phosphoric acid plus chromic acid, and after rinsing and drying, the topography of the grained surfaces thus obtained was examined.

The electrograining time was 120 seconds for Comparative Examples 1 to 4 and Embodiments 1 to 19, and 60 seconds for Embodiment 20. The conditions and results for these examples are summarized in the following Table 1.

The terms "anodic duty cycle" and "cathodic duty cycle" defined in the present invention indicate $t_A/t_A + t_C$ and $t_C/t_A + t_C$, respectively.

Table 1

| | No. | Voltage (V) $V_A$ | Voltage (V) $V_C$ | Current density (A/dm²) $P_A$ | Current density (A/dm²) $P_C$ | Coulombic input ratio ($Q_C/Q_A$) | Time ratio ($t_C/t_A$) | Applied waveform (frequency) | Result of graining: Uniformity | Result of graining: Surface roughness Hmax (μ) |
|---|---|---|---|---|---|---|---|---|---|---|
| Comparative Example | 1 | 30 | 30 | 29.6 | 22.0 | 0.75 | 1 | Commercial AC (60Hz) | X | 8.7 |
| | 2 | 27 | 27 | 35.2 | 28.8 | 0.82 | " | " | X | 4.4 |
| | 3 | 20 | 20 | 26.0 | 21.5 | 0.83 | " | Rectangular (100Hz) | X | 6.9 |
| | 4 | 20 | 30 | 25.6 | 30.0 | 0.78 | 0.66 | " | X | 7.4 |
| Examples of Invention | 1 | 34 | 24 | 34.0 | 20.4 | 0.60 | 1 | Sinusoidal wave (60Hz) | 0 | 8.2 |
| | 2 | 34 | 20 | 34.0 | 17.0 | 0.50 | " | " | ◎ | 8.6 |
| | 3 | 34 | 16 | 34.0 | 13.6 | 0.40 | " | " | 0 | 7.6 |
| | 4 | 34 | 14 | 34.0 | 12.0 | 0.35 | " | " | Δ | 10.0 |
| | 5 | 30 | 24 | 29.0 | 20.5 | 0.70 | " | " | 0 | 7.6 |
| | 6 | 30 | 20 | 29.0 | 16.2 | 0.56 | " | " | 0 | 8.1 |
| | 7 | 30 | 18 | 29.0 | 15.0 | 0.51 | " | " | ◎ | 9.0 |
| | 8 | 30 | 16 | 29.0 | 12.8 | 0.44 | " | " | ◎ | 7.5 |
| | 9 | 30 | 14 | 29.0 | 11.5 | 0.39 | " | " | Δ | 9.5 |
| | 10 | 20 | 15 | 27.5 | 13.2 | 0.72 | 1.5 | Rectangular wave (100Hz) | Δ | 8.0 |
| | 11 | 20 | 13 | 27.5 | 11.4 | 0.62 | " | " | ◎ | 6.0 |
| | 12 | 20 | 11 | 27.5 | 10.8 | 0.59 | " | " | ◎ | 5.4 |
| | 13 | 20 | 9 | 27.5 | 9.0 | 0.49 | " | " | ◎ | 4.5 |
| | 14 | 20 | 7 | 27.5 | 6.6 | 0.36 | " | " | 0 | 3.2 |
| | 15 | 20 | 18 | 27.5 | 18.0 | 0.69 | " | " | 0 | 8.6 |
| | 16 | 20 | 16 | 27.5 | 16.2 | 0.62 | " | " | 0 | 7.8 |
| | 17 | 20 | 14 | 27.5 | 14.4 | 0.55 | " | " | ◎ | 7.0 |
| | 18 | 20 | 12 | 27.5 | 12.0 | 0.46 | " | " | 0 | 3.6 |
| | 19 | 20 | 13 | 27.5 | 11.4 | 0.62 | 1.5 | Trapezoidal wave(100Hz) | ◎ | 6.0 |
| | 20 | 26 | 11 | 50.4 | 19.2 | 0.57 | " | " | 0 | 2.8 |

In Comparative Examples 1 and 2, conventional AC current having a sinusoidal wave and with equal anodic and cathodic voltages was applied, and in Comparative Example 3, equal anodic and cathodic voltages in a rectangular wave-form. In Comparative Example 4, the cathodic voltage ($V_C$) was higher than the anodic voltage ($V_A$). These examples are given for comparison with the process of the present invention.

In Table 1, $V_A$ shows the peak value for the anodic voltage, and $V_C$, that for the cathodic voltage, while $P_A$ shows the peak value of anodic current density, and $P_C$, that for the cathodic current density (excluding values due to transient behavior).

Of the symbols used in the table to show the results of graining, the symbol X indicates an unevenly pitted structure, and the symbol 0 an almost uniformly grained "pits-within-a-pit" structure; while the symbol indicates that the graining was uniform over the entire surface, with a "pits-within-a-pit" structure, i.e., the graining was ideal. Symbol Δ means that the graining was not quite uniform, or if uniform, not a "pits-within-a-pit" structure.

The surface roughness Hmax (μ) is a measure of pit depth (maximum values) measured by using a Profilometer, a product of Institut Dr. Foerster.

As is apparent from the results of Table 1, in the embodiments of the present invention, aluminum sheets which were electrograined using electrolytes of hydrochloric acid, with a regulated alternating current adjusted to a $Q_C/Q_A$ of 0.8 or less by adjusting the anodic and cathodic voltages, acquired a uniform "pits-within-a-pit" surface grain structure preferable for good printability. In addition, the embodiments show that pit depth can be widely changed between 3 to 10μ by adjusting the anodic and cathodic voltages (ratio) properly. On the contrary, grained substrates by conventional hydrochloric acid and commercial AC did not show the uniform "pits-within-a-pit" structure, and even when the alternating current was modified to a special wave-form, such as a rectangular wave, (Comparative Examples 3 and 4), with the anodic voltage ($V_A$) equal to the cathodic voltage ($V_C$) or with the cathodic voltage ($V_C$) higher than the anodic voltage ($V_A$), grained surfaces with preferable "pits-within-a-pit" structure were not obtained.

EXAMPLES 21 to 34

In these examples, aluminum sheets of 99.5% purity (50 × 100 × 0.3mm) were etched in caustic soda solution, rinsed, and electrograined in an electrolyte of nitric acid of 1.5 wt % concentration and 20° C solution temperature, using various kinds of regulated alternating current with voltage wave-forms as shown in FIGS. 1 and 2, i.e., sinusoidal wave, rectangular wave, and trapezoidal wave, with different anodic and cathodic voltages ($V_A$, $V_C$), anodic and cathodic times ($t_A$, $t_C$) and for frequencies ($f$) and different graining times. Then, the smut adhering to the surfaces was removed by immersion in a hot solution of phosphoric acid plus chromic acid, and after rinsing and drying, the topography of the grained surfaces thus obtained was examined. The experimental conditions and results are summarized in the following Table 2.

Table 2

| | No. | Voltage V $V_A$ | Voltage V $V_C$ | Current density A/cm² $P_A$ | Current density A/cm² $P_C$ | Electrolytic time Sec | Coulombic input ratio ($Q_C/Q_A$) | Time ratio ($t_C/t_A$) | Applied waveform (frequency) | Result of graining: Uniformity | Result of graining: Surface roughness Hmax (μ) |
|---|---|---|---|---|---|---|---|---|---|---|---|
| Comparative Example | 5 | 16 | 16 | 28.2 | 26.4 | 60 | 0.94 | 1 | Commercial AC (60Hz) | X | 2.2 |
| | 6 | 18 | 18 | 33.0 | 30.0 | 60 | 0.91 | " | " | 0 | 2.1 |
| | 7 | 20 | 20 | 37.2 | 31.2 | 60 | 0.84 | " | " | Δ | 2.2 |
| | 8 | 22 | 22 | 41.4 | 35.4 | 60 | 0.86 | " | " | X | — |
| | 9 | 20 | 16 | 38.4 | 19.2 | 45 | 0.33 | 0.667 | Rectangular wave (100Hz) | X | — |
| | 10 | 20 | 22 | 38.4 | 30.0 | 45 | 0.52 | " | " | X | — |
| | 11 | 20 | 20 | 38.4 | 28.8 | 45 | 0.50 | " | " | X | — |
| Examples | 21 | 22 | 20 | 38.4 | 28.8 | 60 | 0.75 | 1 | Sinusoidal wave (60Hz) | ◎ | 2.2 |
| | 22 | 24 | 20 | 43.2 | 30.0 | 60 | 0.69 | " | " | ◎ | 2.5 |
| | 23 | 26 | 20 | 46.2 | 30.0 | 60 | 0.65 | " | " | ◎ | 3.2 |
| | 24 | 24 | 20 | 43.2 | 30.6 | 45 | 0.71 | " | " | ◎ | 2.4 |
| | 25 | 26 | 20 | 47.4 | 31.2 | 45 | 0.66 | " | " | ◎ | 3.0 |
| | 26 | 26 | 22 | 57.6 | 36.0 | 45 | 0.63 | " | " | ◎ | 3.1 |
| Examples | 27 | 16.5 | 13 | 30.0 | 16.8 | 45 | 0.56 | " | Rectangular wave (100Hz) | ◎ | 2.9 |
| | 28 | 20 | 15 | 38.4 | 16.8 | 45 | 0.44 | " | " | ◎ | 3.0 |
| | 29 | 20 | 14 | 38.4 | 15.6 | 45 | 0.41 | " | " | ◎ | 3.3 |
| | 30 | 19 | 12 | 31.2 | 14.4 | 45 | 0.69 | 1.5 | Rectangular wave (60Hz) | ◎ | 2.6 |
| | 31 | 22 | 12 | 37.8 | 16.2 | 45 | 0.64 | " | " | ◎ | 3.5 |
| | 32 | 24 | 14 | 43.2 | 19.2 | 30 | 0.67 | " | " | ◎ | 3.2 |
| | 33 | 22 | 12 | 37.5 | 19.5 | 45 | 0.64 | " | Trapezoidal wave (60Hz) | ◎ | 3.3 |
| | 34 | 19 | 12 | 31.3 | 14.3 | 45 | 0.69 | " | " | ◎ | 2.5 |

In Comparative Examples 5 to 8, conventional AC current with equal anodic and cathodic voltages was applied and in Comparative Examples 9 to 11, the anodic time ($t_A$) was larger than the cathodic time ($t_C$) in a rectangular current wave-form. In Comparative Example 10, the cathodic voltage ($V_C$) was higher than the anodic voltage ($V_A$), and in Comparative Example 11, the voltages were equal. These examples are given for comparison with the process of the present invention.

In Table 2 as in Table 1, $V_A$ is the peak value for anodic voltage, and $V_C$ for cathodic voltage, and $P_A$ is the peak value for anodic current density, and $P_C$ for cathodic current density (excluding values due to transient behavior).

Of the symbols used to convey the results of the graining, symbol X indicates unevenly pitted structure, while symbols ◎ means that the favorable "pits-within-a-pit" grain structure was formed uniformly over the entire surface. Symbol Δ indicates that the grain structure was not quite uniform. The surface roughness. Hmax (μ) is a measure of pit depth (maximum value) measured by using a Profilometer, a product of Institut Dr. Foerster, as in Table 1.

As is apparent from the results of Table 2, in the example of the present invention, where aluminum sheets were electrograined by using an electrolyte of nitric acid, and a regulated alternating current adjusted to $Q_C/Q_A$ of about 0.4 to 0.8 by variation in the anodic and cathodic voltages and time ratio ($t_C/t_A$) respectively, the treated substrates had a uniform "pits-within-a-pit" grain structure preferable for good printability. In addition, the embodiments show that pit depth can be changed somewhat by adjusting the anodic and cathodic voltages properly.

In contrast, where the anodic voltage ($V_A$) was equal to the cathodic voltage ($V_C$) using the nitric acid electrolyte and commercial AC, the pits of the grained substrates were shallow, and it was difficult to control the electrolytic conditions so as to shorten electrolytic time. Furthermore, even when using a regulated alternating current with a special wave-form, such as rectangular wave, (Comparative Examples 9 to 11) in which the anodic time ($t_A$) was longer than the cathodic time ($t_C$), there was not produced uniformly grained surfaces with the preferred "pits-within-a-pit" grain structure, irrespective of where the anodic voltage was higher than, equal to, or lower than the cathodic voltage.

Compared to the conventional method using nitric acid electrolyte and commercial AC, Examples 21 to 34 of the present invention are characterized by stable and favorable grained substrates which can be produced over a wide range of electrolyte compositions since the electrolytic treatment time can be reduced and electrolytic conditions best suited for the respective electrolyte compositions can be employed.

In order to illustrate the actual printing performance of lithographic plates made from grained substrates of aluminum sheets obtained by the present process, grained substrates obtained by the conventional commercial AC method in Comparative Examples 2 and 6 and the grained substrates obtained by Examples 12 and 33 were respectively anodized in a sulfuric acid bath and made into lithographic plates using a diazo sensitizer. These plates were employed in offset printing, and the plates produced from grained substrates resulting from Examples 12 and 33 were far superior in image reproduction than those produced by the conventional method in Comparative Examples 2 and 6. Furthermore, the former was favorable in durability, and showed no deterioration until after printing 30,000 copies with the plate of Example 12 and 50,000 copies for the plate of Example 33, respectively.

The present invention achieves a uniformly and finely grained substrate of the "pits-within-a-pit" structure efficiently with a very short electrolysis time, even using a conventional electrolyte of hydrochloric acid which normally produces only a deeply but simply pitted structure. It also achieves a reasonably deeply and uniformly grained substrate with very short electrolysis time, even using a conventional electrolyte of nitric acid which normally produces a shallowly grained "pits-within-a-pit" structure. Therefore, compared to the prior art, the present invention imparts superior printability to lithographic plates electrograined in an electrolyte of hydrochloric acid, and superior durability to plates electrograined in an electrolyte of nitric acid. Furthermore, it permits the pit depth to be optionally adjusted by proper selection of electrolytic conditions.

The regulated alternating current employed in this invention can be provided from common appropriate wave generators.

For example, the sinusoidal wave can be obtained with a specific DC-AC invertor utilizing pulse width modulation method, the rectangular wave by a invertor utilizing thyristors, and the trapezoidal wave by combination of an appropriate out-put filter and the rectangular wave.

What is claimed is:

1. A process for electrolytically etching aluminum substrates to impart thereto a uniform "pits-within-a-pit" surface structure for lithographic printing, comprising the steps of subjecting the aluminum substrate to electrolytic etching in an electrolytic cell filled with an electrolyte consisting essentially of hydrochloric acid or nitric acid; by means of a regulated alternating current applying an inter-electrode voltage with the anodic voltage of greater magnitude than cathodic voltage and the ratio of the cathodic coulombic input to the anodic coulombic input being less than 1, said ratio being in the range of 0.3–0.8 for a hydrochloric acid containing electrolyte and in the range of 0.4–0.8 for a nitric acid containing electrolyte.

2. The process according to claim 1, wherein the anodic half-cycle period in said regulated alternating current is equal or less than the cathodic half-cycle period.

3. The process according to claim 1, wherein said coulombic input ratio is in the range of 0.4 to 0.7.

4. The process according to claim 1, wherein, said anodic voltage is 10 to 50V, and said cathodic voltage is lower than said anodic voltage.

5. The process of claim 1 wherein said cell includes a graphite counter electrode.

* * * * *